US005542830A

United States Patent [19]

Yuzaki

[11] Patent Number: 5,542,830

[45] Date of Patent: Aug. 6, 1996

[54] BEARING LUBRICATION FOR SCROLL-TYPE COMPRESSOR

[75] Inventor: Tsuneo Yuzaki, Aichi-ken, Japan

[73] Assignee: Mitsubishi Jukogyo Kabushiki Kaisha, Tokyo, Japan

[21] Appl. No.: 502,825

[22] Filed: Jul. 14, 1995

[30] Foreign Application Priority Data

Aug. 9, 1994 [JP] Japan ..... 6-206082

[51] Int. Cl.[6] ..... F01C 1/04

[52] U.S. Cl. ..... 418/55.6; 184/6.16

[58] Field of Search ..... 418/55.1, 55.5, 418/55.6; 184/6.16

[56] References Cited

U.S. PATENT DOCUMENTS

| | | | |
|---|---|---|---|
| 5,217,359 | 6/1993 | Kawahara et al. | 418/55.6 |
| 5,308,231 | 5/1994 | Bookbinder et al. | 418/55.6 |
| 5,413,469 | 5/1995 | Nakajima et al. | 418/55.6 |
| 5,431,550 | 7/1995 | Otake | 418/55.6 |

FOREIGN PATENT DOCUMENTS

| | | | |
|---|---|---|---|
| 109291 | 5/1988 | Japan | 418/55.6 |
| 3-105093 | 5/1991 | Japan . | |

*Primary Examiner*—Charles Freay
*Attorney, Agent, or Firm*—Arnold, White & Durkee

[57] ABSTRACT

In the scroll-type compressor of the present invention, the end surface of a flange provided in a protruding manner at the outer periphery of the outer end surface of a drive bush is sealingly slid on the inner end surface of a rotation shaft to form an enclosed space on the side of the drive bush, the rotation shaft is formed with a through hole one end of which is open to the central portion of the inner end surface of the rotation shaft and the other end of which is open to the outer peripheral surface of the rotation shaft, and a horizontal hole passing through the drive bush in the axial direction and communicating with the enclosed space is formed in the drive bush. When the rotation shaft is rotated, a pressure difference is generated between one end and the other end of the through hole by a centrifugal force. This pressure difference allows gas to flow through a gap of a rotating bearing, a horizontal hole of the drive bush, the enclosed space, and the through hole in that order, and the rotating bearing is lubricated by a mist of lubricating oil contained in this gas. Whereby, oil is stably supplied to the rotating bearing for journaling the drive bush fitted into a boss provided in a protruding manner at the central portion on the outer surface of the end plate of the orbiting scroll, so that poor lubrication and the resultant seizure and reduced life can be prevented.

4 Claims, 4 Drawing Sheets

BEARING LUBRICATION FOR SCROLL-TYPE COMPRESSOR

FIELD OF THE INVENTION AND RELATED ART STATEMENT

The present invention relates to a scroll-type compressor.

One example of a scroll-type compressor relating to the present invention is shown in FIG. 5.

Referring to FIG. 5, an enclosed housing 1 consists of a cup-shaped body 2 and a front end plate 4 fastened to the cup-shaped body 2 with bolts 3.

A rotation shaft 7, passing through the front end plate 4, is rotatably supported by the front end plate 4 via bearings 8 and 9.

A fixed scroll 10 and an orbiting scroll 14 are disposed in the enclosed housing 1.

The fixed scroll 10 has an end plate 11 and a spiral wrap 12 erected on the inner surface of the end plate 11. The end plate 11 is fastened to the cup-shaped body 2 with bolts 13.

The orbiting scroll 14 has an end plate 15 and a spiral wrap 16 erected on the inner surface of the end plate 15. The spiral wrap 16 has substantially the same shape as that of the spiral wrap 12 of the fixed scroll 10.

The spiral wrap 16 of the orbiting scroll 14 and the spiral wrap 12 of the fixed scroll 10 are off-centered with each other by an orbiting radius, and engaged with each other by shifting through an angle of 180° as shown in the figure.

Accordingly, a tip seal 17 embedded in the tip end surface of the spiral wrap 12 is in contact with the inner surface of the end plate 15, a tip seal 18 embedded in the tip end surface of the spiral wrap 16 is in contact with the inner surface of the end plate 11, and the side surfaces of the spiral wraps 12 and 16 are in line contact with each other at a plurality of places.

A plurality of enclosed small chambers 19*a* and 19*b* are defined so as to be symmetrical with respect to the centers of spirals of the spiral wraps 12 and 16, and a small chamber 22 is defined at the central portion of the spiral.

A drive bush 21 is rotatably fitted via a rotating bearing 23 in a cylindrical boss 20 provided in an protruding manner at the central portion on the outer surface of the end plate 15. An eccentric pin 25, which is provided in a protruding manner on the inner end surface of the rotation shaft 7, is rotatably fitted into an eccentric hole 24 formed in the drive bush 21. Between the outer peripheral edge of the outer surface of the end plate 15 and the inner surface of the front end plate 4, a rotation checking mechanism 26, which is also used as a thrust bearing, is disposed.

When the rotation shaft 7 is rotated, the orbiting scroll 14 is driven via the eccentric pin 25, the drive bush 21, the rotating bearing 23, and the boss 20. The orbiting scroll 14 orbits on a circle with the orbiting radius, that is, the radius of eccentricity between the rotation shaft 7 and the eccentric pin 25 while its rotation is checked by the rotation checking mechanism 26.

By this orbiting motion, the line contacting portion between the spiral wraps 12 and 16 moves successively toward the spiral center. As a result, the enclosed small chambers 19*a* and 19*b* move toward the spiral center while decreasing their volumes.

Thereupon, gas flowing into a suction chamber 28 through a suction port, not shown, is introduced into the enclosed small chambers 19*a* and 19*b* through the outer end opening of the spiral wraps 12 and 16, and reaches the small chamber 22 at the center while being compressed. The compressed gas passes through a discharge port 29 formed in the end plate 11 of the fixed scroll 10, pushes to open a discharge valve 30, and is discharged into a defined discharge chamber 31, flowing to the outside through a not illustrated discharge port.

In FIG. 5, reference numeral 5 denotes a balance weight installed to the rotation shaft 7, 27 denotes a balance weight installed to the drive bush 21, 32 denotes a retainer for the discharge valve 30, and 33 denotes a bolt for fastening the discharge valve 30 and the retainer 32 to the end plate 11.

In the above-described scroll-type compressor relating to the present invention, the rotating bearing 23 journaling the drive bush 21 fitted into the cylindrical boss 20 is lubricated by a mist of lubricating oil contained in the gas sucked into the suction chamber 28.

For this reason, the oil supply to the rotating bearing 23 is varied by the change in operating conditions (number of revolutions, pressure and temperature of gas, etc.) of the compressor, so that the oil supply is unstable. Also, since the place where the rotating bearing 23 is fitted constitutes a dead end, it is difficult for the gas to flow in this place.

Therefore, when the operating conditions of the compressor are severe, the lubrication of the rotating bearing 23 becomes poor because of insufficient oil supply, resulting in the seizure and reduced life of the rotating bearing 23, so that the reliability of the compressor may be decreased.

OBJECT AND SUMMARY OF THE INVENTION

The present invention was made in view of the above-described situation. Accordingly, an object of the present invention is to solve the above problems and to provide a scroll-type compressor which has been improved so that a rotating bearing of an orbiting scroll can be lubricated by a mist of lubricating oil contained in gas to prevent poor lubrication under a severe operating condition.

To achieve the above object, the present invention is configured as follows:

(1) In a scroll-type compressor in which a fixed scroll and an orbiting scroll, each having a spiral wrap erected on the inner surface of an end plate, are engaged with each other, a drive bush is rotatably fitted, via a rotating bearing, into a boss provided in a protruding manner at the central portion on the outer surface of the end plate of the orbiting scroll, and an eccentric pin protruding from the inner end surface of a rotation shaft is fitted into an eccentric hole formed in the drive bush, the end surface of a flange provided in a protruding manner at the outer periphery of the outer end surface of the drive bush is sealingly slid on the inner end surface of the rotation shaft to form an enclosed space on the side of the drive bush, the rotation shaft is formed with a through hole one end of which is open to the central portion of the inner end surface of the rotation shaft and the other end of which is open to the outer peripheral surface of the rotation shaft, and a horizontal hole passing through the drive bush in the axial direction and communicating with the enclosed space is formed in the drive bush so that a gas passage is formed so as to pass through a gap of the rotating bearing, the horizontal hole in the drive bush, and the enclosed space and reach the other end of the through hole formed in the rotation shaft.

(2) In a scroll-type compressor in which a fixed scroll and an orbiting scroll, each having a spiral wrap erected on the inner surface of an end plate, are engaged with each other, a drive bush is rotatably fitted, via a rotating bearing, into a boss provided in a protruding manner at the central portion on the outer surface of the end plate of the orbiting scroll, and an eccentric pin protruding from the inner end surface of a rotation shaft is slidably fitted into a slide groove formed in the drive bush, the end surface of a flange provided in a protruding manner at the outer periphery of the outer end surface of the drive bush is sealingly slid on the inner end surface of the rotation shaft to form an enclosed space on the side of the drive bush, and the rotation shaft is formed with a through hole one end of which is open to the central portion of the inner end surface of the rotation shaft and the other end of which is open to the outer peripheral surface of the rotation shaft, so that a gas passage is formed so as to pass through the gap of the rotating bearing, a longitudinal gap between the slide groove and an eccentric pin, and the enclosed space and reach the other end of the through hole formed in the rotation shaft.

(3) In the above item (1) or (2), the other end of the through hole is open to the outer peripheral surface of a balance weight fixed to the rotation shaft.

(4) In the above item (1) or (2), the other end of the through hole is open to the outer end of a pipe which is disposed in the radial direction with the inner end thereof being jointed to the rotation shaft.

In the invention described in the above item (1), when the rotation shaft is rotated, a pressure difference is generated between one end and the other end of the through hole by a centrifugal force. This pressure difference allows gas to flow through the gap of the rotating bearing, the horizontal hole of the drive bush, the enclosed space, and the through hole in that order, and the rotating bearing is lubricated by a mist of lubricating oil contained in this gas.

As a result, oil can be stably supplied to the rotating bearing, so that poor lubrication under a severe operating condition of compressor and the resultant seizure and reduced life can be prevented. Therefore, the reliability of the compressor can be improved.

In the invention described in the above item (2), when the rotation shaft is rotated, a pressure difference is generated between one end and the other end of the through hole by a centrifugal force. This pressure difference allows the gas containing a mist of lubricating oil to flow through the gap of the rotating bearing, the longitudinal gap between the slide groove and the eccentric pin, the enclosed space, and the through hole in that order.

Therefore, in the invention described in item (2), the same effect as that of the invention in item (1) can be achieved, and additionally, since the gas is allowed to flow by using the gap between the slide groove and the eccentric pin, the horizontal hole need not be formed in the drive bush. Also, oil can be supplied to the sliding surface between the slide groove and the eccentric pin.

In the invention described in the above item (3), when the rotation shaft is rotated, a pressure difference is generated between one end of the through hole and the other end which is open to the outer peripheral surface of the balance weight by a centrifugal force, so that a gas flow passing through the rotating bearing is produced.

In the invention described in the above item (4), when the rotation shaft is rotated, a pressure difference is generated between one end of the through hole and the opening at the outer end of pipe, so that a gas flow passing through the rotating bearing is produced.

In the invention described in the above items (3) and (4), the amount of gas passing through the rotating bearing can be increased by improving the centrifugal pump action due to the turning of the rotation shaft.

BRIEF DESCRIPTION OF THE DRAWINGS

FIG. 1 shows a first embodiment of the present invention, in which

FIG. 2 FIG. 2(A) is a longitudinal sectional view of a principal portion.

FIG. 3 shows a third embodiment of the present invention, in which

FIG. 4 shows a fourth embodiment of the present invention, in which

DETAILED DESCRIPTION OF A PREFERRED EMBODIMENTS

Preferred embodiments of the present invention will be described typically in detail below with reference to the drawings.

A first embodiment of the present invention is shown in FIG. 1.

Figure 1A:
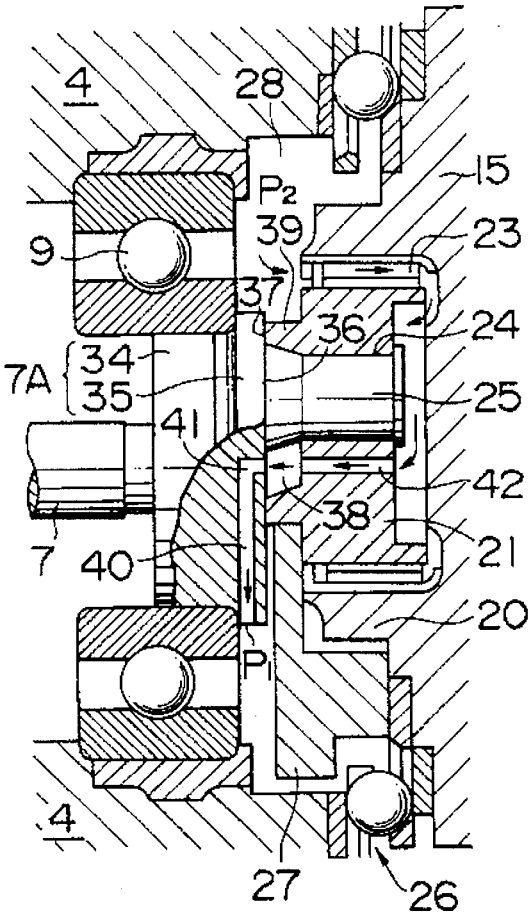
FIG. 1(A) is a longitudinal sectional view of a principal portion.
Figure 1B:
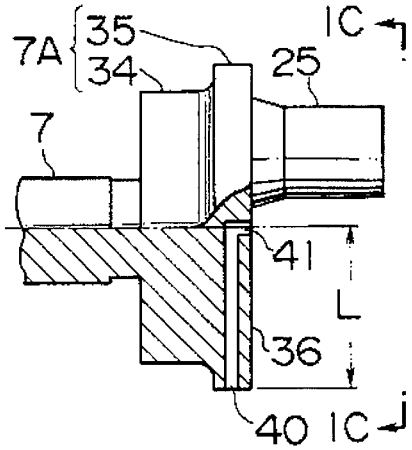
FIG. 1(B) is a partially longitudinal sectional view of a rotation shaft.
Figure 1C:
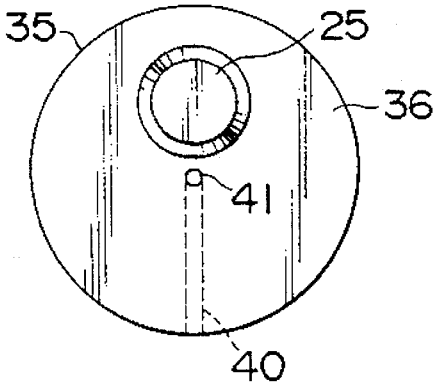
FIG. 1(C) is a side view taken along the line C—C of FIG. 1(B)

As shown in FIGS. 1(A), 1(B), and 1(C), a disk-shaped collar portion 7A consisting of an engaging portion 34 of a bearing 9 and a locking portion 35 of the bearing 9 is formed at the inner end portion of a rotation shaft 7. The rotation shaft 7 has a vertical hole 40 formed perpendicularly to the axis thereof and a horizontal hole 41 formed along the axis. The vertical hole 40 is open to the outer peripheral surface of the locking portion 35, while the horizontal hole 41 is open to the central portion of a inner end surface 36 of the rotation shaft 7. These two holes 40 and 41 communicate with each other in the rotation shaft 7, constituting a through hole.

Figure 1D:
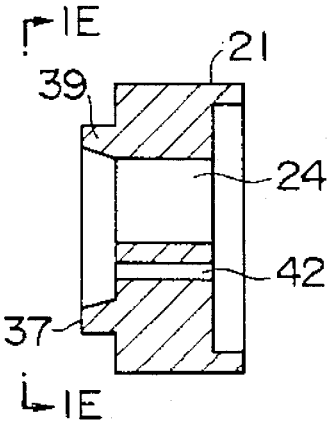
FIG. 1(D) is a longitudinal sectional view of a drive bush.
Figure 1E:
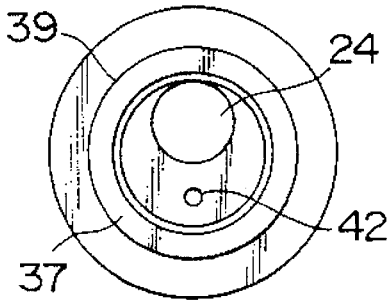
FIG. 1(E) is a side view taken along the line E—E of FIG. 1(D)

At the outer periphery of the outer end surface of the drive bush 21, a flange 39 is provided in a protruding manner as shown in FIGS. 1(A), 1(D), and 1(E). By sealingly sliding an end surface 37 of the flange 39 on the inner end surface 36 of the rotation shaft 7, an enclosed space 38 is defined on the side of the drive bush 21.

The drive bush 21 is formed with a horizontal hole 42 passing through the drive bush 21 in the axial direction. This horizontal hole 42 is open to the enclosed space 38 at the position opposite to the horizontal hole 41.

A second embodiment of the present invention is shown in FIG. 2.

In the second embodiment, the mechanism for transmitting the turning torque of the rotation shaft 7 to the orbiting scroll 14 is of a slide type.

Figure 2A:
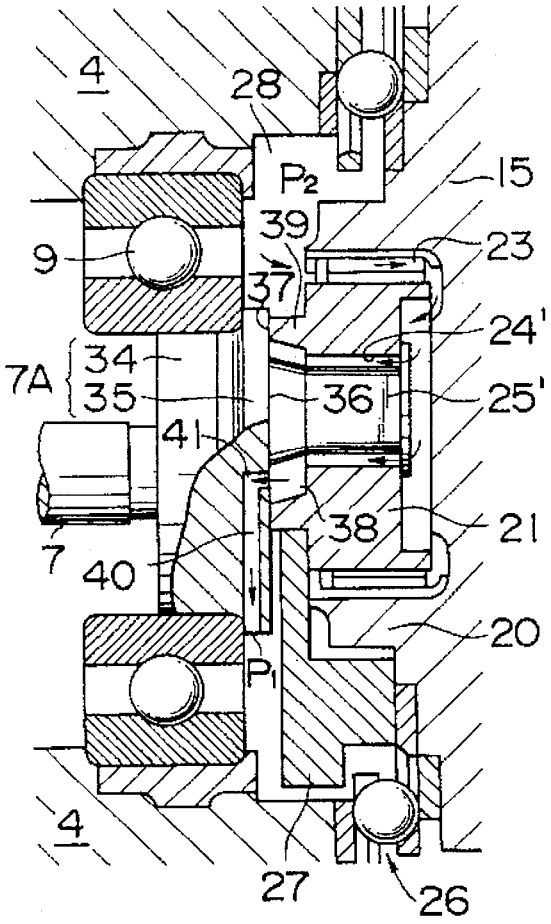
Figure 2B:
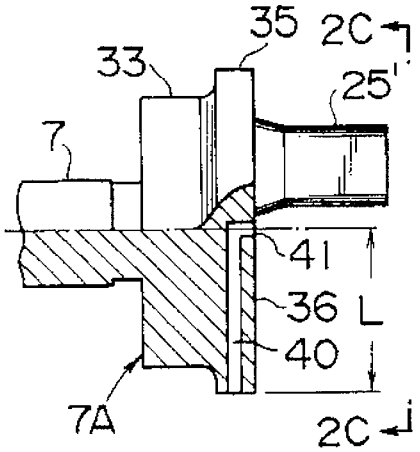
FIG. 2(B) is a partially longitudinal sectional view of a rotation shaft.
Figure 2C:
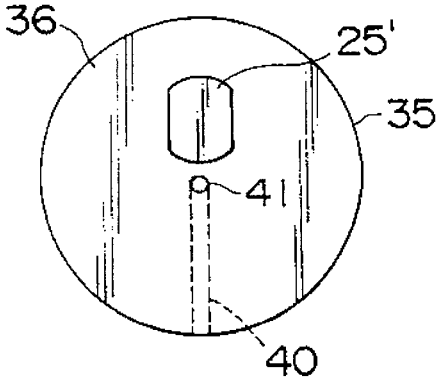
FIG. 2(C) is a side view taken along the line C—C of FIG. 2(B)
Figure 2D:
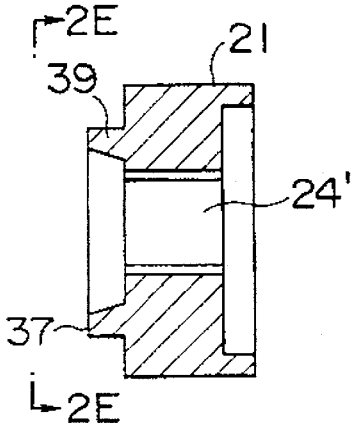
FIG. 2(D) is a longitudinal sectional view of a drive bush.
Figure 2E:
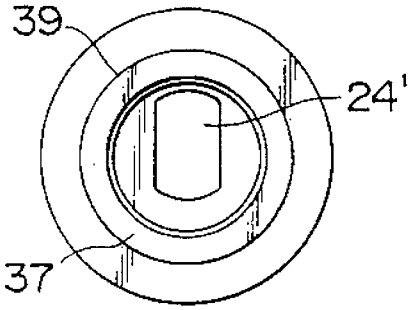
FIG. 2(E) is a side view taken along the line E—E of FIG. 2(D)

Specifically, as shown in FIGS. 2(A), 2(D), and 2(E), the drive bush 21 is provided with a slide groove 24', and an eccentric pin 25', provided in a protruding manner on the inner end surface 36 of the rotation shaft 7, is slidably fitted into the slide groove 24' in the longitudinal direction.

The rotation shaft 7 is formed with the vertical hole 40 and the horizontal hole 41 like the first embodiment, these holes constituting a through hole.

When the rotation shaft 7 is rotated, like the first embodiment, a centrifugal pump mechanism is formed by the vertical hole 40 and the horizontal hole 41. Therefore, as indicated by the solid line arrow marks in FIG. 2(A), a gas flow is formed so as to pass through the suction chamber 28, the gap of the rotating bearing 23, the longitudinal gap between the slide groove 24' and the eccentric pin 25', the enclosed space 38, and the through hole 41, 40 in that order. Whereby, the rotating bearing 23 and the sliding surface between the slide groove 24' and the eccentric pin 25' are forcedly supplied with oil by the centrifugal pump mechanism, so that stable oiling can be ensured.

Figure 3A:
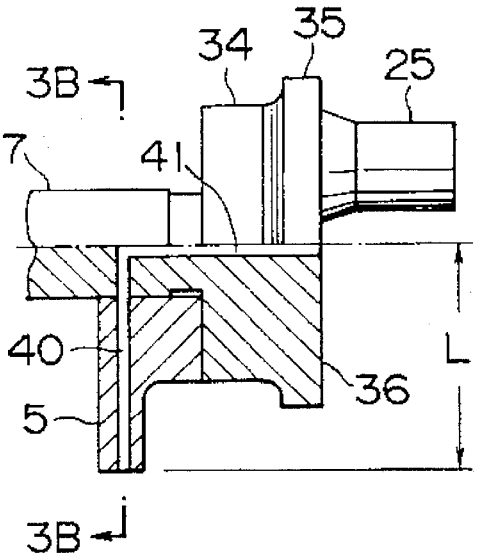
FIG. 3(A) is a partially longitudinal sectional view of a rotation shaft.
Figure 3B:
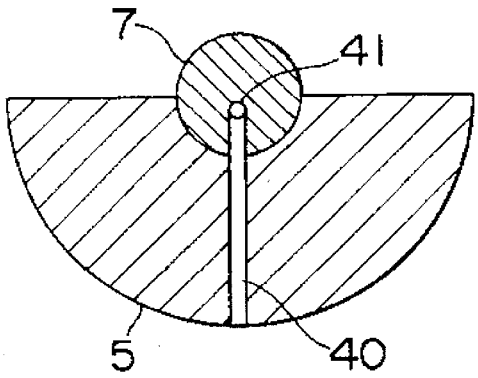
FIG. 3(B) is a sectional view taken along the line B—B of FIG. 3(A)
Figure 4A:
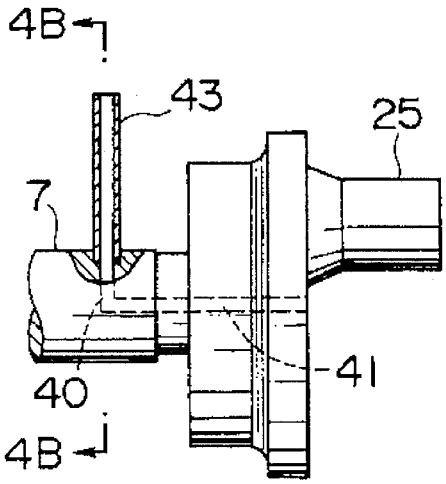
FIG. 4(A) is a partially longitudinal sectional view of a rotation shaft.
Figure 4B:
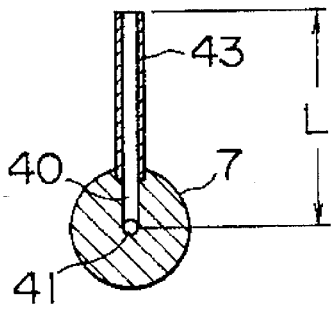
FIG. 4(B) is a sectional view taken along the line B—B of FIG. 4(A)
Figure 5:
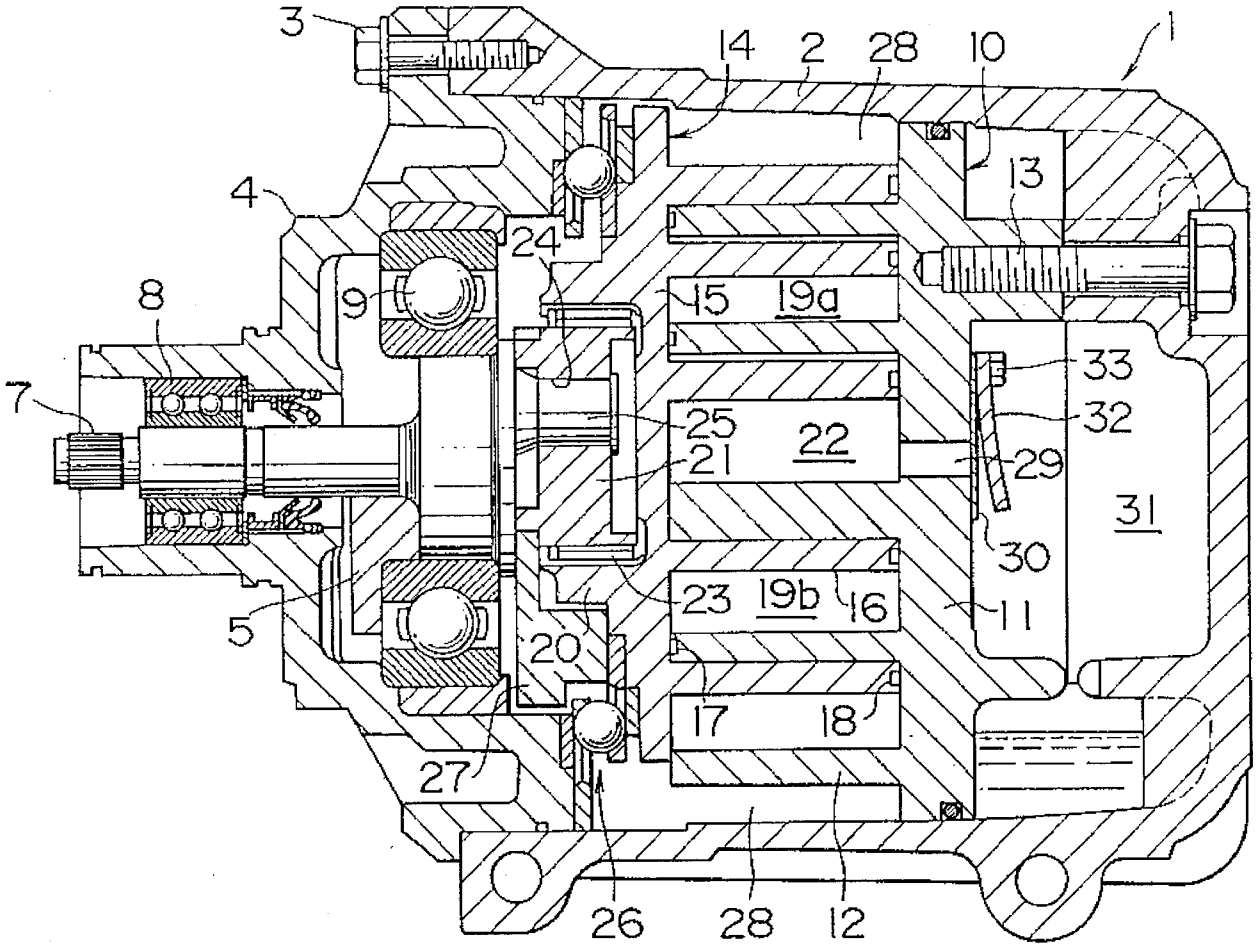
FIG. 5 RELATED ART
FIG. 5 is a longitudinal sectional view of a scroll-type compressor relating to the present invention.

To form the centrifugal pump mechanism in the rotation shaft 7, a distance L may be formed in the radial direction between one end of the through hole and the other end thereof. As shown in FIG. 3, the vertical hole 40 may be formed in a balance weight 5 fixed integrally to the rotation shaft 7 so that the other end of the through hole is open to the outer peripheral surface of the balance weight 5. Alternatively, as shown in FIG. 4, a pipe 43 may be disposed in the radial direction with the inner end thereof being joined to the rotation shaft 7 so that the other end of the through hole is open to the outer end of the pipe 43.

I claim:

1. A scroll-type compressor in which a fixed scroll and an orbiting scroll, each having a spiral wrap erected on the inner surface of an end plate, are engaged with each other, a drive bush is rotatably fitted, via a rotating bearing, into a boss provided in a protruding manner at the central portion on the outer surface of said end plate of said orbiting scroll, a rotation shaft having an inner end surface and an outer peripheral surface, and an eccentric pin protruding from the inner end surface of a rotation shaft is fitted into an eccentric hole formed in said drive bush, comprising:

a flange protruding from said drive bush is sealingly slid on the inner end surface of said rotation shaft to form an enclosed space on said drive bush, said rotation shaft is formed with a through hole one end of which is open to the inner end surface of said rotation shaft and the other end of which is open to the outer peripheral surface of said rotation shaft, and a horizontal hole passing through said drive bush in the axial direction and communicating with said enclosed space is formed in said drive bush so that a gas passage is formed so as to pass through said rotating bearing, said horizontal hole in said drive bush, said enclosed space and said other end of said through hole formed in said rotation shaft.

2. A scroll-type compressor in which a fixed scroll and an orbiting scroll, each having a spiral wrap erected on the inner surface of an end plate, are engaged with each other, a drive bush is rotatably fitted, via a rotating bearing, into a boss provided in a protruding manner at the central portion on the outer surface of said end plate of said orbiting scroll, a rotation shaft having an inner end surface and an outer peripheral surface, and an eccentric pin protruding from the inner end surface of a rotation shaft is slidably fitted into a slide groove formed in said drive bush, comprising;

a flange protruding from said drive bush is sealingly slid on the inner end surface of said rotation shaft to form an enclosed space on said drive bush, and said rotation shaft is formed with a through hole one end of which is open to the inner end surface of said rotation shaft and the other end of which is open to the outer peripheral surface of said rotation shaft, so that a gas passage is formed so as to pass through said rotating bearing, a longitudinal gap between said slide groove and said eccentric pin, said enclosed space and the other end of said through hole formed in said rotation shaft.

3. A scroll-type compressor according to claim 1 or 2, including a balance weight fixed to said rotation shaft, wherein the other end of said through hole is open to the outer peripheral surface of said balance weight fixed to said rotation shaft.

4. A scroll-type compressor according to claim 1 or 2, including a pipe which is disposed in the radial direction, wherein the other end of said through hole is open to said pipe which is disposed in the radial direction jointed to said rotation shaft.

* * * * *